US007291430B2

(12) United States Patent
Main et al.

(10) Patent No.: US 7,291,430 B2
(45) **Date of Patent: *Nov. 6, 2007**

(54) IMAGING MEMBERS

(75) Inventors: Anna M. Main, Rochester, NY (US); Liang-Bih Lin, Webster, NY (US); John S. Chambers, Rochester, NY (US); James M. Duff, Mississauga (CA); Timothy P. Bender, Port Credit (CA)

(73) Assignee: Xerox Corporation, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/188,679

(22) Filed: Jul. 2, 2002

(65) Prior Publication Data

US 2004/0009418 A1 Jan. 15, 2004

(51) Int. Cl.
*G03G 15/02* (2006.01)

(52) U.S. Cl. ..... 430/59.4; 430/83; 430/123.43

(58) Field of Classification Search ..... 430/59.4, 430/59.1, 58.8, 58.75, 83, 58.05, 58.15, 58.25, 430/120, 123.43

See application file for complete search history.

(56) References Cited

U.S. PATENT DOCUMENTS

| | | | | |
|---|---|---|---|---|
| 4,265,990 | A | 5/1981 | Stolka et al. | |
| 4,410,616 | A | 10/1983 | Griffiths et al. | |
| 4,433,039 | A * | 2/1984 | Miyakawa et al. | 430/59.3 |
| 4,992,349 | A | 2/1991 | Chen | |
| 5,153,085 | A * | 10/1992 | Akasaki et al. | 430/58.25 |
| 5,336,577 | A | 8/1994 | Spiewak et al. | |
| 5,449,580 | A * | 9/1995 | Nakamori et al. | 430/58.25 |
| 5,468,583 | A * | 11/1995 | Gruenbaum et al. | 430/58.5 |
| 5,688,619 | A * | 11/1997 | Hongo et al. | 430/59.4 |
| 6,063,534 | A * | 5/2000 | Hamasaki | 430/72 |
| 6,156,468 | A * | 12/2000 | Wehelie et al. | 430/65 |
| 6,485,873 | B1 | 11/2002 | Ohkura | |
| 6,573,016 | B2 * | 6/2003 | Kami et al. | 430/58.05 |
| 6,586,148 | B1 * | 7/2003 | Graham et al. | 430/58.65 |
| 6,936,387 | B2 * | 8/2005 | Yao et al. | 430/66 |

FOREIGN PATENT DOCUMENTS

JP 07-199486 * 8/1995

OTHER PUBLICATIONS

Japanese Patent Office Machine-Assisted Translation of JP 07-199486 (pub Aug. 4, 1995).*

Diamond, A. S. ed, *Handbook of Imaging Materials*, Marcel Dekker, Inc., NY (1991), pp. 395-396.*

*Derwent* Machine-Assisted English-Language Translation of JP 07-199486 A (pub Aug. 1995).*

Diamond, A.S., ed., *Handbook of Imaging Materials*, Marcel Dekker, Inc., NY (1991), pp. 427-436.*

* cited by examiner

*Primary Examiner*—Janis L. Dote
(74) *Attorney, Agent, or Firm*—Eugene O. Palazzo; Fay Sharpe LLP

(57) ABSTRACT

A member including for example, a substrate, a charge blocking layer, an optional adhesive layer, a charge generating layer comprising particles comprising a photogenerating layer of for example, chlorogallium phthalocyanine dispersed in a matrix comprising a charge transport molecule, an electron transport molecule which functions to sensitize the chlorogallium phthalocyanine pigment in the charge generating layer and mixtures thereof, and a film forming binder.

9 Claims, No Drawings

IMAGING MEMBERS

CROSS REFERENCE TO COPENDING APPLICATION

U.S. patent application Ser. No. 09/302,524, filed in the names of D. Murti, et al on Apr. 30, 1999, discloses a photoconductive imaging member which is comprised of a supporting substrate, and thereover a layer comprised of a photogenerator hydroxygallium component, a charge transport component, and an electron transport component. U.S. patent application Ser. No. 09/627,283, filed in the names of Lin, et al on Jul. 28, 2000 discloses an imaging member having a single electrophotographic layer. The entire disclosure of this Patent Application is incorporated herein by reference.

BACKGROUND

The present invention is generally directed to layered imaging members, and imaging apparatus and processes thereof. More specifically, the present invention relates in general to electrophotographic imaging members and more specifically, to electrophotographic imaging members having higher pigment photosensitivities for more stable photoinduced discharge characteristics (PIDC) curves at typical exposure energy of from about 2 to about 5 ergs/cm$^2$, and to processes for forming images on the member.

Higher pigment photosensitivities in photoreceptors refers for example, to a device wherein the chlorogallium phthalocyanine photogenerating pigment is sensitized without modifying the charge generation layer preparation and manufacturing procedures. In embodiments, a small percentage of electron transport molecules are doped in the charge transport layer to sensitize the chlorogallium phthalocyanine pigment in the charge generating layer.

Numerous imaging members for electrostatographic imaging systems are known including selenium, selenium alloys, such as arsenic selenium alloys; layered inorganic imaging, and layered organic members. Examples of layered organic imaging members include those containing a charge transporting layer and a charge generating layer. Thus, for example, an illustrative layered organic imaging member can be comprised of a conductive substrate, overcoated with a charge generator layer, which in turn is overcoated with a charge transport layer, and an optional overcoat layer overcoated on the charge transport layer. In a further "inverted" variation of this device, the charge transporter layer can be overcoated with the photogenerator layer or charge generator layer. Examples of generator layers that can be employed in these members include, for example, charge generator materials such as selenium, cadmium sulfide, vanadyl phthalocyanine, x-metal free phthalocyanine, benzimidazole perylent (BZP), hydroxygallium phthalocyanine (HOGaPc), chlorogallium phthalocyanine, and trigonal selenium dispersed in binder resin, while examples of transport layers include dispersions of various diamines, reference for example, U.S. Pat. No. 4,265,990, the disclosure of which is incorporated herein by reference in its entirety.

One problem encountered with photoreceptors comprising a charge generating layer and the charge transport layer is that the thickness of the charge transport layer, which is normally the outermost layer, tends to become thinner during image cycling. This change in thickness causes changes in the electrical properties of the photoreceptor. Thus, in order to maintain image quality, complex and sophisticated electronic equipment is necessary in the imaging machine to compensate for the electrical changes. This increases the complexity of the machine, cost of the machine, size of the footprint occupied by the machine, and the like. Without proper compensation of the changing electrical properties of the photoreceptor during cycling, the quality of the images formed degrades due to spreading of the charge pattern on the surface of the imaging member and a decline in image resolution. High quality images are essential for digital copiers, duplicators, printers, and facsimile machines, particularly laser exposure machines that demand high resolution images.

There continues to be a need for improved imaging members, and improved imaging systems utilizing such members. Additionally, there continues to be a need for imaging members of varying sensitivity, which members are economical to prepare and retain their properties over extended periods of time A number of current electrophotographic imaging members comprise chlorogallium phthalocyanine as the photogenerating pigment. This pigment is sensitive to processing speed, photosensitivity and photoinduced discharge, characteristics vary with respect to different charging energies and different development times.

One feature of this invention is to improve photosensitivities of electrophotographic imaging members and photoreceptors for example, allow for more stable photoinduced discharge characteristics curves.

REFERENCES

In U.S. Pat. No. 4,410,616, to Griffiths, et al., issued Oct. 18, 1983, there is disclosed an improved ambi-polar photoresponsive device useful in imaging systems for the production of positive images, from either positive or negative originals, which device is comprised of: (a) supporting substrate, (b) a first photogenerating layer, (c) a charge transport layer, and (d) a second photogenerating layer, wherein the charge transport layer is comprised of a highly insulating organic resin having dissolved therein small molecules of an electrically active material of N,N'-diphenyl-N,N'-bis("X substituted" phenyl)-[1,1,-biphenyl]-4,4'-diamine wherein X is selected from the group consisting of alkyl and halogen.

U.S. Pat. No. 4,265,990 to Stolka et al, issued May 5, 1981 illustrates a photosensitive member having at least two electrically operative layers is disclosed. The first layer comprises a photoconductive layer which is capable of photogenerating holes and injecting photogenerated holes into a contiguous charge transport layer. The charge transport layer comprises a polycarbonate resin containing from about 25 to about 75 percent by weight of one or more of a compound having a specified general formula. This structure may be imaged in the conventional imaging mode which usually includes charging, exposure to light and development.

U.S. Pat. No. 5,336,577 to Spiewak et al, issued Aug. 9, 1994, discloses a thick organic ambipolar layer on a photoresponsive device is simultaneously capable of charge generation and charge transport. In particular, the organic photoresponsive layer contains an electron transport material such as a fluorenylidene malonitrile derivative and a hole transport material such as a dihydroxy tetraphenyl benzadine containing polymer. These may be complexed to provide photoresponsivity, and/or a photoresponsive pigment, or dye may also be included.

The entire disclosures of these patents are incorporated herein by reference.

BRIEF SUMMARY

Disclosed herein is an improved electrophotographic imaging member comprising a flexible supporting substrate having an electrically conductive layer, a charge blocking layer, an optional adhesive layer, a charge-generating layer, a charge transporting layer comprising an electron transport molecule, and a film forming binder.

Further disclosed is an improved electrophotographic imaging member comprising a photogenerating layer comprising photogenerating pigments dispersed in an inactive resin binder, and wherein the photogenerator layer is situated between the substrate and the charge transport layer.

An imaging process is also disclosed. The process includes providing a member comprising a conductive supporting layer, a photogenerating layer, and a binder.

Also disclosed is an improved electrophotographic imaging member comprising an electron transport molecule in the charge transport layer which functions to sensitize the chlorogallium phthalocyanine pigment in the charge generating layer.

Further disclosed herein is an improved electrophotographic imaging member for which photoinduced discharge characteristics (PIDC) curves do not change with time or repeated use.

Aspects illustrated herein relate to;

a substrate, a charge blocking layer, an optional adhesive layer, a charge generating layer comprising particles comprising a photogenerating layer of for example, hydroxygallium phthalocyanine Type V, x-polymorph metal free phthalocyanine, or chlorogallium phthalocyanine dispersed in a matrix comprising:

a charge transport molecule selected, for example, from the group consisting of an arylamine and a hydrazone and an electron transport molecule selected for example, from the group consisting of, a carboxylfluorenone malonitrile (CFM) derivative represented by:

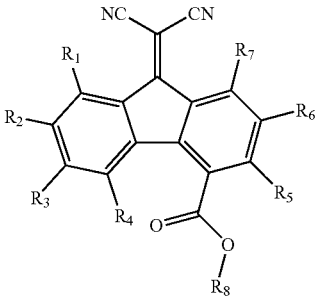

wherein each R is independently selected from the group consisting of hydrogen, alkyl containing from about 1 to about 40 carbon atoms, alkoxy containing from about 1 to about 40 carbon atoms, phenyl, substituted phenyl, higher aromatic for example, as naphthalene and anthracene, alkylphenyl containing about 6 to about 40 carbons, alkoxyphenyl containing from about 6 to about 40 carbons, aryl containing from about 6 to about 30 carbons, substituted aryl containing from about 6 to about 30 carbons and halogen, or a nitrated fluorenone derivative represented by:

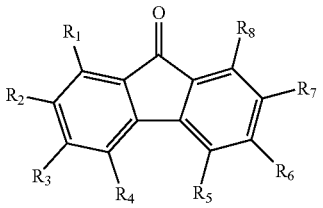

wherein each R is independently selected from the group consisting of hydrogen, alkyl containing from about 1 to about 40 carbon atoms, alkoxy containing from about 1 to about 40 carbon atoms, phenyl, substituted phenyl, higher aromatic for example, naphthalene and anthracene, alkylphenyl containing from about 6 to about 40 carbons, alkoxyphenyl containing from about 6 to about 40 carbons, aryl containing from about 6 to about 30 carbons, substituted aryl containing from about 6 to about 30 carbons, nitro groups, and halogen, and at least 2 R groups are chosen to be nitro groups, or a N-$R_1$-N'-$R_2$-1,4,5,8-naphthalenetetracarboxylic diimide derivative represented by:

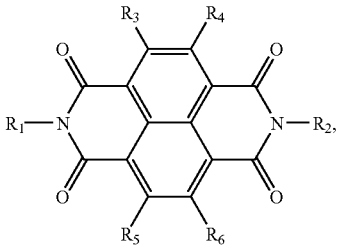

wherein R1 is a substituted or unsubstituted alkyl, branched alkyl, cycloalkyl, alkoxy or aryl, for example, phenyl, naphthyl, or a higher polycyclic aromatic for example, as anthracene, R2 is alkyl, branched alkyl, cycloalkyl, or aryl, for example, phenyl, naphthyl, or a higher polycyclic aromatic for example, anthracene or the same as R1 and R2 can be chosen independently to have a total carbon number from about 1 to about 50, and in embodiments from about 1 to about 12. R1 and R2 may be selected from the group consisting of alkyl, alkoxy, and halogen. R3, R4, R5 and R6 are alkyl, branched alkyl, cycloalkyl, alkoxy or aryl, for example, phenyl, naphthyl, or a higher polycyclic aromatic for example, anthracene or halogen and the like. R3, R4, R5 and R6 can be the same or different. In the case where R3, R4, R5 and R6 are carbon, they can be chosen independently to have a total carbon number from about 1 to about 50 and in embodiments from about 1 to about 12.

The charge transport layer preferably includes charge transport molecules in an amount of from about 10 to about 70 wt % based on the total weight of the charge transport layer. The charge transport layer can include charge transport molecules such as N,N'-diphenyl-N,N'-bis(3-methylphenyl)-[1,1'-biphenyl]-4,4'diamine; N,N'-diphenyl-N,N'-bis(alkylphenyl)-1,1'-biphenyl-4,4'-diamine; Tritolylamine; N,N'-bis-(3,4-dimethylphenyl)-4-biphenyl amine; N,N'-bis- (4-methylphenyl)-N,N'-bis(4-ethylphenyl)-1,1'-3,3'-dimethylbiphenyl-4,4'-diamine; phenanthrene diamine; and stilbene.

or a 1,1'-dioxo-2-(aryl)-6-phenyl-4-(dicyanomethylidene) thiopyran derivative represented by:

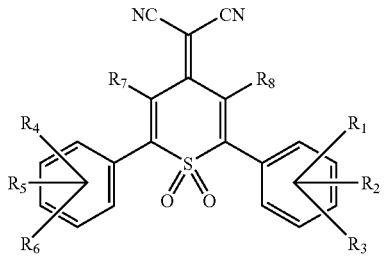

wherein each R is independently selected from the group consisting of hydrogen, alkyl containing from about 1 to about 40 carbon atoms, alkoxy containing from about 1 to about 40 carbon atoms, phenyl, substituted phenyl, higher aromatic for example, naphthalene and anthracene, alkylphenyl containing from about 6 to about 40 carbons, alkoxyphenyl containing from about 6 to about 40 carbons, aryl containing from about 6 to about 30 carbons, substituted aryl containing from about 6 to about 30 carbons and halogen, or a carboxybenzylnaphthaquinone derivative represented by:

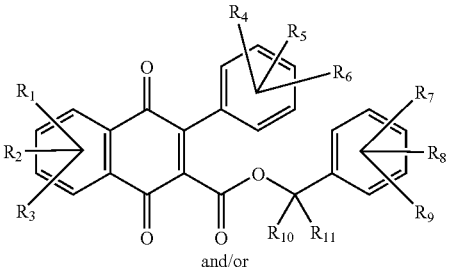

and/or

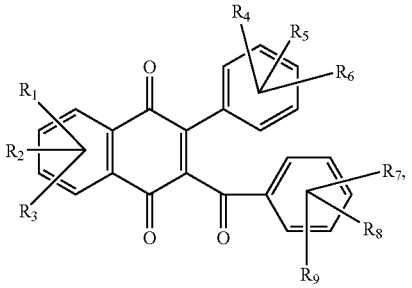

wherein each R is independently selected from the group consisting of hydrogen, alkyl, alkoxy, aryl, alkyl containing from about 1 to about 40 carbon atoms, alkoxy containing from about 1 to about 40 carbon atoms, phenyl, substituted phenyl, higher aromatic for example, naphthalene and anthracene, alkylphenyl containing from about 6 to about 40 carbons, alkoxyphenyl containing from about 6 to about 40 carbons, aryl containing from about 6 to about 30 carbons, substituted aryl containing from about 6 to about 30 carbons and halogen, or a diphenoquinone represented by:

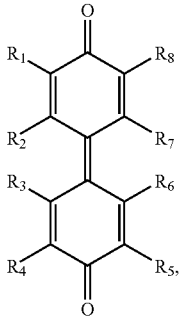

wherein each R is independently selected from the group consisting of hydrogen, alkyl, alkoxy, aryl, alkyl containing from about 1 to about 40 carbon atoms, alkoxy containing from about 1 to about 40 carbon atoms, phenyl, substituted phenyl, higher aromatic for example, naphthalene and anthracene, alkylphenyl containing from about 6 to about 40 carbons, alkoxyphenyl containing from about 6 to about 40 carbons, aryl containing from about 6 to about 30 carbons, substituted aryl containing from about 6 to about 30 carbons and halogen, and mixtures thereof;

a film forming binder.

The imaging member may be imaged by depositing a uniform electrostatic charge on the imaging member, exposing the imaging member to activating radiation in an image configuration to form an electrostatic latent image, and developing the latent image with electrostatically attractable marking particles to form a toner image in conformance to the latent image.

Any suitable substrate may be employed in the imaging member of this invention. The substrate may be opaque or substantially transparent, and may comprise any suitable material having the requisite mechanical properties. Thus, for example, the substrate may comprise a layer of insulating material including inorganic or organic polymeric materials, such as MYLAR® a commercially available polymer, MYLAR® coated titanium, a layer of an organic or inorganic material having a semiconductive surface layer, such as indium, tin, oxide, aluminum, titanium and the like, or exclusively be made up of a conductive material such as aluminum, chromium, nickel, brass and the like. The substrate may be flexible, seamless or rigid and may have a number of many different configurations, such as, for example, a plate, a drum, a scroll, an endless flexible belt, and the like. In one embodiment, the substrate is in the form of a seamless flexible belt. The back of the substrate, particularly when the substrate is a flexible organic polymeric material, may optionally be coated with a conventional anticurl layer.

The thickness of the substrate layer depends on numerous factors, including mechanical performance and economic considerations. The thickness of this layer may range from about 65 micrometers to about 3,000 micrometers, and in embodiments from about 75 micrometers to about 1,000 micrometers for optimum flexibility and minimum induced surface bending stress when cycled around small diameter rollers, for example, 19 millimeter diameter rollers. The surface of the substrate layer is preferably cleaned prior to coating to promote greater adhesion of the deposited coating composition. Cleaning may be effected by, for example, exposing the surface of the substrate layer to plasma discharge, ion bombardment, and the like methods.

Electron blocking layers for positively charged photoreceptors allow holes from the imaging surface of the photoreceptor to migrate toward the conductive layer. For negatively charged photoreceptors, any suitable charge blocking layer capable of forming a barrier to prevent hole injection from the conductive layer to the opposite photoconductive layer may be utilized. The charge blocking layer may include polymers such as polyvinylbutyral, epoxy resins, polyesters, polysiloxanes, polyamides, polyurethanes and the like, or may be nitrogen containing siloxanes or nitrogen containing titanium compounds such as, trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$, gamma-aminobutyl) methyl diethoxysilane, and $[H_2N(CH_2)_3]CH_3Si(OCH_3)_2$, (gamma-aminopropyl)-methyl diethoxysilane, as disclosed in U.S. Pat. Nos. 4,338,387, 4,286,033 and 4,291,110. Other suitable charge blocking layer polymer compositions are also described in U.S. Pat. No. 5,244,762. These include vinyl hydroxyl ester and vinyl hydroxy amide polymers wherein the hydroxyl groups have been partially modified to benzoate and acetate esters which modified polymers are then blended with other unmodified vinyl hydroxy ester and amide unmodified polymers. An example of such a blend is a 30 mole percent benzoate ester of poly (2-hydroxyethyl methacrylate) blended with the parent polymer poly (2-hydroxyethyl methacrylate). Still other suitable charge blocking layer polymer compositions are described in U.S. Pat. No. 4,988,597. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate). The disclosures of the U.S. Patents are incorporated herein by reference in their entirety.

The blocking layer is continuous and may have a thickness of less than about 10 micrometers because greater thicknesses may lead to undesirably high residual voltage. In embodiments, a blocking layer of from about 0.005 micrometers to about 1.5 micrometers facilitates charge neutralization after the exposure step and optimum electrical performance is achieved. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is preferably applied in the form of a dilute solution, with the solvent being removed after deposition of the coating by conventional techniques such as by vacuum, heating and the like. Generally, a weight ratio of blocking layer material and solvent of between about 0.05:100 to about 5:100 is satisfactory for spray coating.

If desired an optional adhesive layer may be formed on the substrate. Typical materials employed in an undercoat layer include, for example, polyesters, polyamides, poly (vinyl butyral), poly(vinyl alcohol), polyurethane and polyacrylonitrile, and the like. Typical polyesters include, for example, VITEL® PE100 and PE200 available from Goodyear Chemicals, and MOR-ESTER 49,000® available from Norton International. The undercoat layer may have any suitable thickness, for example, of from about 0.001 micrometers to about 30 micrometers. A thickness of from about 0.1 micrometers to about 3 micrometers is used in a specific embodiment. Optionally, the undercoat layer may contain suitable amounts of additives, for example, of from about 1 weight percent to about 10 weight percent, of conductive or nonconductive particles, such as zinc oxide, titanium dioxide, silicon nitride, carbon black, and the like, to enhance, for example, electrical and optical properties. The undercoat layer can be coated onto a supporting substrate from a suitable solvent. Typical solvents include, for example, tetrahydrofuran, dichloromethane, xylene, ethanol, methyl ethyl ketone, and mixtures thereof.

The components of the charge generating layer comprise photogenerating particles for example, of Type V hydroxygallium phthalocyanine, x-polymorph metal free phthalocyanine, or chlorogallium phthalocyanine photogenerating pigments dispersed in a matrix comprising an charge transport molecule and certain selected electron transport molecules. Type V hydroxygallium phthalocyanine is well known and has X-ray powder diffraction (XRPD) peaks at, for example, Bragg angles (2 theta +/−0.2°) of 7.4, 9.8, 12.4, 16.2, 17.6, 18.4, 21.9, 23.9, 25.0, 28.1, with the highest peak at 7.4 degrees. The X-ray powder diffraction traces (XRPDs) were generated on a Philips X-Ray Powder Diffractometer Model 1710 using X-radiation of CuK-alpha wavelength (0.1542 nanometer). The Diffractometer was equipped with a graphite monochrometer and pulse-height discrimination system. Two-theta is the Bragg angle commonly referred to in x-ray crystallographic measurements. I (counts) represents the intensity of the diffraction as a function of Bragg angle as measured with a proportional counter. Type V hydroxygallium phthalocyanine may be prepared by hydrolyzing a gallium phthalocyanine precursor including dissolving the hydroxygallium phthalocyanine in a strong acid and then reprecipitating the resulting dissolved precursor in a basic aqueous media; removing any ionic species formed by washing with water; concentrating the resulting aqueous slurry comprising water and hydroxygallium phthalocyanine as a wet cake; removing water from the wet cake by drying; and subjecting the resulting dry pigment to mixing with a second solvent to form the Type V hydroxygallium phthalocyanine. These pigment particles in one embodiment have an average particle size of less than about 5 micrometers.

The charge generating layer containing photoconductive compositions and/or pigments and the resinous binder material generally ranges in thickness of from about 0.1 micrometers to about 5.0 micrometers, and in embodiments has a thickness of from about 0.3 micrometers to about 3 micrometers. The charge generating layer thickness is generally related to binder content. Thus, for example, higher binder content compositions generally require thicker layers for photogeneration. Of course, thicknesses outside these ranges can be selected providing the objectives of the present disclosure are achieved.

Any suitable arylamine hole transport molecules may be utilized in the charge generating layer. In embodiments an arylamine hole transport molecule may be represented by the following structural formula:

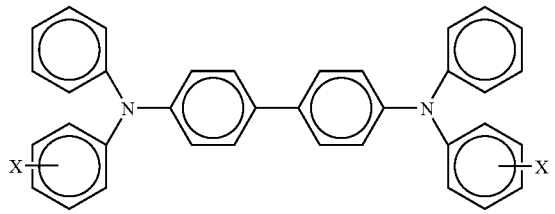

wherein X is selected from the group consisting of alkyl and halogen. Typically, the halogen is a chloride. The alkyl typically contains from about 1 to about 10 carbon atoms, and in embodiments from about 1 to about 5 carbon atoms. Typical aryl amines include, for example, N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other specific examples of aryl amines include, 9-9-bis(2-cyanoethyl)-2,7-bis(phenyl-m-tolylamino)fluorene, tritolylamine, N,N'-bis(3,4 dimethylphenyl)-N"(1-biphenyl)amine, 2-bis ((4'-methylphenyl)amino-p-phenyl)1,1-diphenyl ethylene, 1-bisphenyl-diphenylamino-1-propene, N,N'-diphenyl-N,N'-bis(3-methylphenyl)-[1,1'-biphenyl]-4,4'-diamine and the like.

The charge generating layer may, in embodiments, contain electron transport molecules in an amount from about 1% to about 40% by weight of an electron transport molecule, based on the combined weight of the arylamine hole transport molecules and the electron transport molecules in the charge generating layer. The electron transport molecule in the charge generating layer of the photoreceptor can be selected from the group consisting of a carboxylfluorenone malonitrile (CFM) derivative represented by:

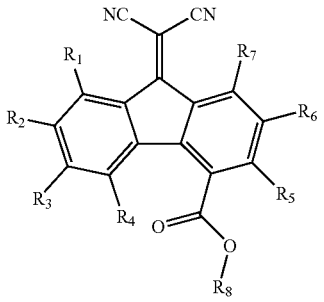

wherein each R is independently selected from the group consisting of hydrogen, alkyl containing from about 1 to about 40 carbon atoms, alkoxy containing from about 1 to about 40 carbon atoms, phenyl, substituted phenyl, higher aromatic for example, naphthalene and anthracene, alkylphenyl containing from about 6 to about 40 carbons, alkoxyphenyl containing from about 6 to about 40 carbons, aryl containing from about 6 to about 30 carbons, substituted aryl containing from about 6 to about 30 carbons and halogen, or a nitrated fluorenone derivative represented by:

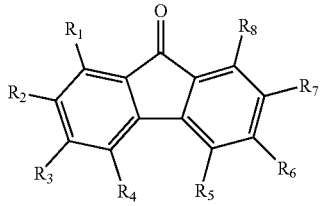

wherein each R is independently selected from the group consisting of hydrogen, alkyl containing from about 1 to about 40 carbon atoms, alkoxy containing from about 1 to about 40 carbon atoms, phenyl, substituted phenyl, higher aromatic for example, naphthalene and anthracene, alkylphenyl containing from about 6 to about 40 carbons, alkoxyphenyl containing from about 6 to about 40 carbons, aryl containing from about 6 to about 30 carbons, substituted aryl containing from about 6 to about 30 carbons, nitro groups, and halogen, and at least 2 R groups are chosen to be nitro groups, or a N-$R_1$-N'-$R_2$-1,4,5,8-naphthalenetetracarboxylic diimide derivative represented by:

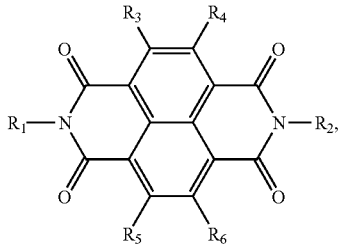

wherein R1 is substituted or unsubstituted alkyl, branched alkyl, cycloalkyl, alkoxy or aryl, for example, phenyl, naphthyl, or a higher polycyclic aromatic for example, anthracene, R2 is alkyl, branched alkyl, cycloalkyl, or aryl, for example, phenyl, naphthyl, or a higher polycyclic aromatic for example, anthracene or the same as R1; R1 and R2 can be chosen independently to have total carbon number from about 1 to about 50 and in embodiments from about 1 to about 12. R3, R4, R5 and R6 are alkyl, branched alkyl, cycloalkyl, alkoxy or aryl, for example, phenyl, naphthyl, or a higher polycyclic aromatic such as anthracene or halogen and the like. R3, R4, R5 and R6 can be the same or different. In the case where R3, R4, R5 and R6 are carbon, they can be chosen independently to have a total carbon number from about 1 to about 50 but is preferred to be from about 1 and to about 12, or a 1,1'-dioxo-2-(aryl)-6-phenyl-4-(dicyanomethylidene) thiopyran derivative represented by:

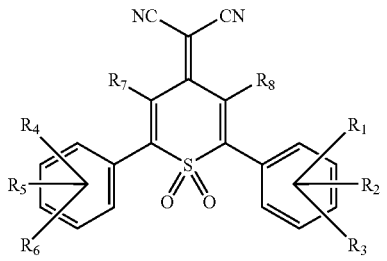

wherein each R is independently selected from the group consisting of hydrogen, alkyl containing from about 1 to about 40 carbon atoms, alkoxy containing from about 1 to about 40 carbon atoms, phenyl, substituted phenyl, or higher aromatic, for example, naphthalene and anthracene, alkylphenyl containing from about 6 to about 40 carbons, alkoxyphenyl containing from about 6 to about 40 carbons, aryl containing from about 6 to about 30 carbons, substituted aryl containing from about 6 to about 30 carbons and halogen, or a carboxybenzylnaphthaquinone derivative represented by:

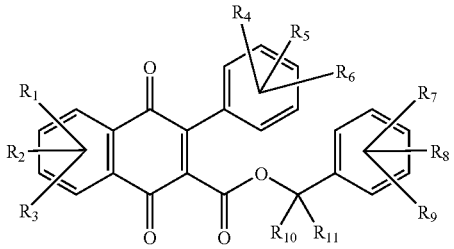

and/or

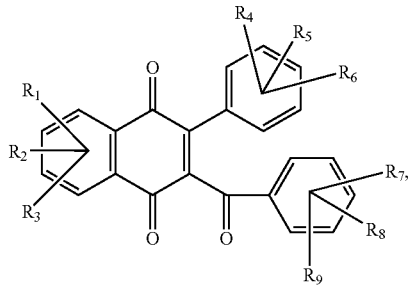

wherein each R is independentty selected from the group consisting of hydrogen, alkyl containing from about 1 to about 40 carbon atoms, alkoxy containing from about 1 to about 40 carbon atoms, phenyl, substituted phenyl, higher aromatic, for example, naphthalene and antracene, alkylphenyl containing from about 6 to about 40 carbons, alkoxyphenyl containing from about 6 to about 40 carbons, aryl containing from about 6 to about 30 carbons, substituted aryl containing from about 6 to about 30 carbons and halogen, or a diphenoquinone derivative represented by:

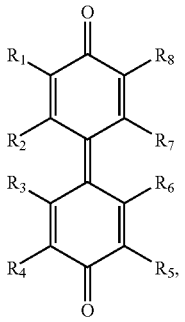

wherein each R is independently selected from the group consisting of hydrogen, alkyl containing from about 1 to about 40 carbon atoms, alkoxy containing from about 1 to about 40 carbon atoms, phenyl, substituted phenyl, higher aromatic for example, naphthalene and antracene, alkylphenyl containing from about 6 to about 40 carbons, alkoxyphenyl containing from about 6 to about 40 carbons, aryl containing from about 6 to about 30 carbons, substituted aryl containing from about 6 to about 30 carbons and halogen, and mixtures thereof, and a film forming binder.

In one embodiment, the combined weight of the arylamine hole transport molecules and electron transport molecules in the charge generating layer is from about 20% to about 80% by weight, based on the total weight of the charge generating layer after drying.

These electron transporting materials contribute to the ambipolar properties of the final photoreceptor and also provide the desired rheology and freedom from agglomeration during the preparation and application of the coating dispersion. Moreover, these electron transporting materials ensure substantial discharge of the photoreceptor during image wise exposure to form the electrostatic latent image.

Any suitable film forming binder may be utilized in the charge generating layer of this imaging member. Typical film forming binders include, for example, polyesters, polyvinyl butyrals, polycarbonates, polystyrene-b-polyvinyl pyridine, poly(vinyl butyral), poly(vinyl carbazole), poly (vinyl chloride), polyacrylates, polymethacrylates, copolymers of vinyl chloride and vinyl acetate, phenoxy resins, polyurethanes, poly(vinyl alcohol), polyacrylonitrile, polystyrene, and the like. Specific electrically inactive binders include polycarbonate resins with a weight average molecular weight of from about 20,000 to about 100,000. In embodiments, a weight average molecular weight of from about 50,000 to about 100,000 is specifically selected. More specifically, good results are achieved with poly(4,4'-diphenyl-1,1'-cyclohexane carbonate), Bisphenol-Z polycarbonate; poly(4,4'-diphenyl-1,1'-cyclohexane carbonate)500, with a weight average molecular weight of 51,000; poly(4,4'-diphenyl-1,1'-cyclohexane carbonate)400, with a weight average molecular weight of 40,000.

The photogenerating composition or pigment may be present in the resinous binder composition in various amounts.

The resinous binder, present in embodiments from about 30 percent by volume to about 60 percent by volume of the photogenerating pigment is dispersed in about 40 percent by volume to about 70 percent by volume of the resinous binder composition. In one embodiment, about 8 percent by volume of the photogenerating pigment is dispersed in about 92 percent by volume of the resinous binder composition. The binder is preferably present in an amount of from about 10% to about 75% by weight of binder based on the total weight of the charge generating layer, more preferably from about 10 wt % to about 30 wt %.

The thickness of the charge generating layer is not particularly critical. Layer thicknesses from about 0.05 micrometer to about 40.0 micrometers may be satisfactory. The charge generating layer containing photoconductive compositions and/or pigments, and the resinous binder material in embodiments range in thickness of from about 0.1 micrometers to about 5.0 micrometers, and has an optimum thickness of from about 0.3 micrometers to about 3 micrometers for best light absorption and improved dark decay stability and mechanical properties.

The photogenerating pigment can be present in various amounts, such as, for example, from about 0.05 weight percent to about 30 weight percent and in embodiments, from about 0.1 weight percent to about 10 weight percent, based on the total weight of the charge generating layer after drying. Charge transport components, such as arylamine hole transport molecules can be present in various effective amounts, for example, of from about 5 weight percent to about 50 weight percent and in embodiments, in an amount of from about 20 weight percent to about 40 weight percent. The electron transport molecule can be present in various amounts, such as, in an amount of from about 1 weight percent to about 40 weight percent and in embodiments, from about 5 weight percent to about 30 weight percent, based on the total combined weight of the hole transport molecules and the electron transport molecules. In embodiments, the combined weight of the arylamine hole transport molecules and the electron transport molecules in the charge generating layer is from about 35 percent to about 65 percent by weight, based on the total weight of the charge generating layer after drying. The low surface energy and low friction enabling polytetrafluroethylene particles can be presented in an amount of about 0.1 weight percent to about 40 weight percent. The GF-300 surfactant can be presented in an amount of from about 0.001 weight percent to about 2 weight percent. The film forming polymer binder can be present in an amount of from about 10 weight percent to about 75 weight percent and in embodiments, from about 30 weight percent to about 60 weight percent, based on the total weight of the charge generating layer after drying. The hole transport and electron transport molecules are dissolved or molecularly dispersed in the film forming binder. The expression "molecularly dispersed", as employed herein is defined as dispersed on a molecular scale.

The above materials can be processed into a dispersion useful for coating by any of the conventional methods used to prepare such materials. These methods include ball milling, media milling (in both vertical or horizontal bead mills), paint shaking the materials with suitable grinding media, and the like to achieve a suitable dispersion. The charge generating layer may be prepared by any suitable method such as, for example, from a dispersion. A typical dispersion is prepared by using the following procedure:

(1) Dispersing the polytetrafluroethylene particles, GF300 surfactant, and the binder by roll milling the materials with glass beads in a mixed solvent of tetrahydrofuran, several hundred grams of 3 mm diameter stainless steel balls (or yttrium fortified zirconium) for from about 2 to about 12 hours, (2) Roll milling the photogenerating pigment and the binder material in a 1:1 weight ratio and from about 10 to about 11 percent solids in tetrahydrofuran along with (3) Weighing the poly(4,4'-diphenyl-1,1'-cyclohexane carbonate and hole and electron transport molecules in tetrahydrofuran and toluene to a 7:3 solvent to weight ratio, (4) adding the mill base and polytetrafluroethylene dispersion to the desirable ratio, and (5) rolling, to mix the materials (without milling beads).

The photogenerating pigment particles, electron transport molecules, and charge transport molecules coating mixture can be coated by any suitable technique, for example, by using a spray coater, dip coater, extrusion coater, roller coater, wire-bar coater, slot coater, doctor blade coater, gravure coater, and the like. Any suitable solvent may be utilized for coating. Typical solvents include, for example, ketones, alcohols, aromatic hydrocarbons, halogenated aliphatic hydrocarbons, ethers, amines, amides, esters, and the like. Specific examples of solvents include cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like. Since the photoresponsive imaging members of the present invention can be prepared by a number of known coating methods, the coating process parameters are dependent on the specific process, materials, coating component proportions, the final coating thickness desired, and the like. Drying may be carried out by any suitable technique. Typically, drying is carried out at a temperature of from about 40 degrees centigrade to about 200 degrees centigrade for a suitable period of time. Typical drying times include, for example, from about 5 minutes to about 10 hours under still or flowing air conditions.

The thickness of the charge generating layer after drying can typically be, for example, from about 3 micrometers to about 50 micrometers and in embodiments, from about 5 micrometers to about 40 micrometers. The maximum thickness of the charge generating layer in any given embodiment is dependent primarily upon factors such as photosensitivity, electrical properties and mechanical considerations.

The imaging member may by employed in any suitable process such as, for example, copying, duplicating, printing, faxing, and the like. Typically, an imaging process may comprise forming a uniform charge on the imaging member of the present invention, exposing the imaging member to activating radiation in image configuration to form an electrostatic latent image, developing the latent image with electrostatically attractable marking material to form a marking material image, and transferring the marking material image to a suitable substrate. If desired, the transferred marking material image may be fixed to the substrate or transferred to a second substrate. Electrostatically attractable marking materials are well known and comprise, for example, a thermoplastic resin, a colorant, such as a pigment, a charge additive, and surface additives. Typical marking materials are disclosed in U.S. Pat. Nos. 4,560,635; 4,298,697 and 4,338,390, the entire disclosures thereof being incorporated herein by reference. Activating radiation may be from any suitable device such as an incandescent light, image bar, laser, and the like. The polarity of the electrostatic latent image on the imaging member of the present invention may be positive or negative. The hydroxygallium, x-polymorph metal free phthalocyanine, and chlorogallium phthalocyanine photogenerating pigments primarily function to absorb the incident radiation and generate electrons and holes. In a negatively charged imaging member, holes are transported to the imaging surface to neutralize negative charge and electrons are transported to the substrate to permit photodischarge. In a positively charged imaging member, electrons are transported to the imaging surface where they neutralize the positive charges and holes are transported to the substrate to enable photodischarge. By selecting the appropriate amounts of hole and electron transport molecules, ambipolar transport can be achieved, that is, the imaging member can be uniformly charged negatively or positively and the member can thereafter be photodischarged.

EMBODIMENTS

Several drum devices of a physical thickness of from about 16 to about 28 micrometers were fabricated using known dip coating techniques. The devices were photoelectrically tested along with surface contact angle measurements. Table 1 shows key electrical results and water contact angles of several devices based on chlorogallium phthalocyanine.

TABLE 1

Sensitization of chlorogallium phthalocyanine-based photoreceptors.

| Device | m-TBD (wt %) | NTDI (wt %) | PCZ | dV/dX (V/ergs/cm$^2$) at 600 V and 24 μm | Dark Decay (V) (163-532 ms) @ 100 nC/cm$^2$ |
|---|---|---|---|---|---|
| Control | 40 | 0 | 60 | 138 | 7 |
| 1 | 40 | 10 | 50 | 172 | 8 |
| 2 | 35 | 15 | 50 | 156 | 12 |
| 3 | 30 | 20 | 50 | 156 | 10 |

m-TBD = N,N'-diphenyl-N,N'-bis(3-methyphenyl)-[1,1'-biphenyl]4,4'diamine
NTDI = N,N'bis(1,2-dimethylpropyl)-1,4,5,8-naphthalenetetracarboxylic diimide
PCZ = poly(4,4'-diphenyl-1,1'-cyclohexane carbonate)

EXAMPLE I

A pigment dispersion was obtained from a large batch of milling, prepared by dyno milling 1.3 kilograms chlorogallium phthalocyanine pigment particles and 867 grams vinylchloride and vinyl acetate copolymers, VMCH, available from UNION CARBIDE in 10.67 kilograms of N-butylacetate and 5.3 kilograms of xylene with 45 kilograms of 1 millimeter diameter zirconium oxide balls for from about 36 to about 72 hours. The milled sample was then filtered with a 20 micrometer pore size nylon filter and 15.3 kilograms of the dispersion were extracted. The charge generation dispersion was further diluted with an additional solvent of 12.9 kilograms of xylene and 5.5 kilograms of butylacetate.

Separately, 5.5 grams of poly(4,4'-diphenyl-1,1'-cyclohexane carbonate), obtained from MITSUBISHI CHEMICAL was weighed along with 4.4 grams N,N'-diphenyl-N,N'-bis(methylphenyl)-1,1-biphenyl-4,4'-diamine, 1.1 grams N,N'bis(1,2-dimethylpropyl)-1,4,5,8-naphthalenetetracarboxylic diimide, and 31.2 grams tetrahydrofuran and 7.8 grams toluene. This mixture was rolled in a glass bottle until the solids were dissolved. Two additional solutions were prepared with the same quantity of polycarbonate, tetrahydrofuran and toluene which comprise 3.85 grams of N,N'-diphenyl-N,N'-bis(methylphenyl)-1,1-biphenyl-4,4'-diamine and 1.65 grams N,N'bis(1,2-dimethylpropyl)-1,4,5,8-naphthalenetetracarboxylic diimide or 3.3 grams of N,N'-diphenyl-N,N'-bis(methylphenyl)-1,1-biphenyl-4,4'-diamine and 2.2 grams of N,N'bis(1,2-dimethylpropyl)-1,4,5,8-naphthalenetetracarboxylic diimide. A reference sample consisting of 4.4 grams N,N'-diphenyl-N,N'-bis(methylphenyl)-1,1-biphenyl-4,4'-diamine, 6.6 grams of polycarbonate, 35.2 grams tetrahydrofuran and 8.8 grams toluene was also prepared.

Devices were prepared by coating, sequentially, the charge generating pigment dispersion at a pull rate of 160 millimeters per minute, and one of the solutions at a pull rate of about 120 to 160 millimeters per minute to aluminum drums having a length of 24 to 36 centimeters and a diameter of 30 millimeters, in which the drums were precoated with a layer of undercoat composed of titanium dioxide, silicon oxide and phenolic resin. The coated devices were then dried at 120 degrees Celsius for 45 minutes and the total thickness of the dried layers were about 22 to about 26 micrometers. Thickness of the dried layers were determined by capacitive measurements and/or by cross section micrograph.

EXAMPLE II

The above devices were electrically tested with a cyclic scanner set to obtain 100 charge-erase cycles immediately followed by an additional 100 cycles, sequences at 2 charge-erase cycles and 1 charge-expose-erase cycle, wherein the light intensity was incrementally increased with cycling to produce a photoinduced discharge curve from which the photosensitivity was measured. The scanner was equipped with a scorotron set to a constant voltage charging at various surface potentials. The devices of Example I were tested at surface potentials of 350, 500, 650, and 800 volts with the exposure light intensity incrementally increased by means of regulating a series of neutral density filters, and the exposure light source was a 780 nanometer light emitting diode. The drum was rotated at a speed of 61 revolutions per minute to produce a surface speed of 25 inches per second or a cycle time of 0.984 seconds. The entire xerographic simulation was carried out in an environmentally controlled light tight chamber at ambient conditions. Forty percent relative humidity and 22 degrees Celsius. Four photoinduced discharge characteristics (PIDC) curves were obtained from the four different pre-exposed surface potentials, and the data were interpolated to a PIDC curve at an initial surface potential of 600 volts, as shown in Table 1. This method provides a valid comparison of electrophotographic properties for different devices.

Electrophotographic properties extrapolated from the interpolated PIDC curves are summarized in Table I. (dV/dX is the slope of a PIDC curve at the initial surface potential and dark decay is the decrease of the surface potential in darkness at a certain time delay since the initial charging).

Although the invention has been described with reference to specific preferred embodiments, it is not intended to be limited thereto, rather those having ordinary skill in the art will recognize that variations and modifications including equivalents, substantial equivalents, similar equivalents, and the like may be made therein which are within the spirit of the invention and within the scope of the claims.

What is claimed is:

1. A member comprising:

a substrate, wherein an electrically conductive support is included when the substrate is non-conductive;

a charge blocking layer;

a charge generating layer comprising a binder and a charge generating layer material selected from the group consisting of hydroxygallium phthalocyanine Type V, x- polymorph metal free phthalocyanine, and chlorogallium phthalocyanine;

a charge transport layer comprising a first electron transport molecule and a binder;

wherein the charge generating layer material is dispersed in a matrix comprising a second electron transport molecule and a charge transport molecule, and wherein said charge transport molecule is an arylamine;

and wherein the charge generating layer comprises from 10 percent to 30 percent by weight of the binder based on the total weight of the charge generating layer after drying, the charge generating layer comprises from about 35 percent to about 65 percent by weight of the charge transport molecule and the electron transport molecule based on the total weight of the charge generating layer after drying, and the charge generating layer comprises from about 1 percent to about 40 percent by weight of said second electron transport molecule based on the combined weight of the charge transport molecule and the electron transport molecule in the charge generating layer after drying, and wherein said second electron transport molecule is a nitrated fluorenone derivative represented by:

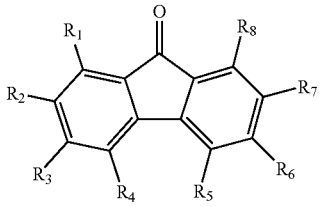

wherein each R is independently selected from the group consisting of hydrogen, alkyl containing from about 1 to about 40 carbon atoms, alkoxy containing from about 1 to about 40 carbon atoms, phenyl, substituted phenyl, naphthalene and anthracene, alkylphenyl containing from about 6 to about 40 carbons, alkoxyphenyl containing from about 6 to about 40 carbons, aryl containing from about 6 to about 30 carbons, substituted aryl containing from about 6 to about 30 carbons, halogen, and nitro, and wherein at least 2 R groups are chosen to be nitro groups.

2. A member according to claim 1 wherein the charge generating layer material comprises chlorogallium phthalocyanine.

3. A member according to claim 1 wherein the charge generating layer has a thickness of from about 3 micrometers to about 50 micrometers.

4. A member according to claim 1 wherein the total amount of all charge transport molecules in the charge transport layer is from about 10 to about 70 weight percent based on the total weight of the charge transport layer.

5. A member according to claim 1 wherein said charge transport molecule is an arylamine represented by:

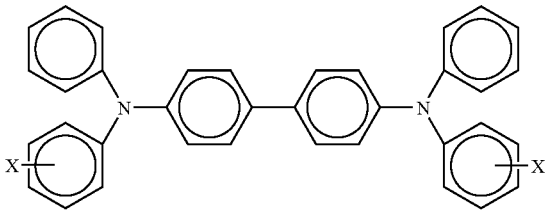

wherein X is selected from the group consisting of alkyl and halogen.

6. A member according to claim 5 wherein the arylamine is N,N'-diphenyl-N,N'-bis(3-methylphenyl)-[1,1'-biphenyl]-4,4'-diamine.

7. A member according to claim 1 wherein the charge transport molecule is selected from the group consisting of N,N'-diphenyl-N,N'-bis(3-methylphenyl)-[1,1'-biphenyl]-4,4'diamine; N,N'-diphenyl-N,N'-bis(alkylphenyl)1,1'-biphenyl-4,4'-diamine; and Tritolylamine.

8. A member according to claim 1 wherein the binder in the charge generating layer is selected from the group consisting of polyesters, polyvinyl butyrals, polycarbonates, polystyrene-b-polyvinyl pyridine, poly(vinyl butyral), poly(vinyl carbazole), poly(vinyl chloride), polyacrylates, polymethacrylates, copolymers of vinyl chloride and vinyl acetate, phenoxy resins, polyurethanes, poly(vinyl alcohol), polyacrylonitrile, and polystyrene.

9. An imaging process comprising providing a member comprising a substrate, wherein an electrically conductive support is included when the substrate is non-conductive;

a charge blocking layer;

a charge generating layer comprising a binder and a charge generating layer material selected from the group consisting of hydroxygallium phthalocyanine Type V, x- polymorph metal free phthalocyanine, and chlorogallium phthalocyanine;

a charge transport layer comprising a first electron transport molecule and a binder;

wherein the charge generating layer material is dispersed in a matrix comprising a second electron transport molecule and a charge transport molecule, and wherein said charge transport molecule is an arylamine;

and wherein the charge generating layer comprises from about 10 percent to 30 percent by weight of the binder based on the total weight of the charge generating layer after drying, the charge generating layer comprises from about 35 percent to about 65 percent by weight of charge transport molecules and electron transport molecules based on the total weight of the charge generating layer after drying, and the charge generating layer comprises from about 1 percent to about 40 percent by weight of said second electron transport molecule based on the combined weight of the charge transport molecules and the electron transport molecules in the charge generating layer after drying, and wherein said second electron transport molecule is a nitrated fluorenone derivative represented by:

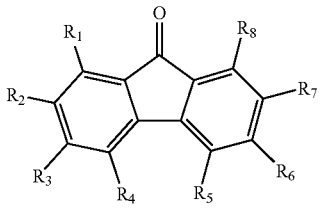

wherein each R is independently selected from the group consisting of hydrogen, alkyl containing from about 1 to about 40 carbon atoms, alkoxy containing from about 1 to about 40 carbon atoms, phenyl, substituted phenyl, naphthalene and anthracene, alkylphenyl containing from about 6 to about 40 carbons, alkoxyphenyl containing from about 6 to about 40 carbons, aryl containing from about 6 to about 30 carbons, substituted aryl containing from about 6 to about 30 carbons, halogen, and nitro, and wherein at least 2 R groups are chosen to be nitro groups;

depositing a uniform electrostatic charge on the member;

exposing the member to activating radiation in an image configuration to form an electrostatic latent image; and developing the latent image with electrostatically attractable marking particles to form a toner image in conformance to the latent image.

* * * * *